United States Patent [19]

Finke

[11] 4,203,534

[45] May 20, 1980

[54] TILTING NOZZLE CLOSURE WITH DUAL SEALING SURFACES

[75] Inventor: Klaus W. Finke, Finnentrop, Fed. Rep. of Germany

[73] Assignee: Robert Finke Kunststoff-Spritzguss-Werk, Finnentrop, Fed. Rep. of Germany

[21] Appl. No.: 934,386

[22] Filed: Aug. 17, 1978

[30] Foreign Application Priority Data

Aug. 25, 1977 [DE] Fed. Rep. of Germany ..... 2738243

[51] Int. Cl.[2] ..... B65D 83/14

[52] U.S. Cl. ..... 222/402.13; 222/402.21; 239/577; 251/349

[58] Field of Search ..... 222/402.1, 402.13, 402.21, 222/402.22, 402.23, 528, 529, 531, 556; 251/349, 354; 239/577

[56] References Cited

U.S. PATENT DOCUMENTS

| | | | |
|---|---|---|---|
| 3,101,876 | 8/1963 | Ayres | 222/402.13 |
| 3,221,952 | 12/1965 | DeSee | 222/529 X |
| 3,434,695 | 3/1969 | Green | 251/349 |
| 3,454,198 | 7/1969 | Flynn | 222/402.22 X |

FOREIGN PATENT DOCUMENTS

| | | | |
|---|---|---|---|
| 2530232 | 2/1977 | Fed. Rep. of Germany | 222/402.22 |
| 7036290 | 6/1977 | Fed. Rep. of Germany | 222/402.22 |

*Primary Examiner*—Robert J. Spar
*Assistant Examiner*—Fred A. Silverberg
*Attorney, Agent, or Firm*—Toren, McGeady and Stanger

[57] ABSTRACT

A tilting nozzle closure for a bottle includes a cap of plastics material having a side wall which has a low elastic deformability carrying an internal annular bead adjacent its open end for engagement with the neck of the bottle at least part of the end wall of the cap being more resilient than the side wall and carrying a tubular nozzle and a closure member for sealing the neck of the bottle which, in use, engages with the end of the neck of the bottle and which includes a reduced portion which in use projects into the neck of the bottle. The closure is arranged such that in use the at least part of the end wall is stressed by the attachment of the cap to the neck of the bottle to urge the closure member against the neck of the bottle to seal the bottle, but the closure member is movable from sealing engagement with the bottle neck to thereby allow the contents of the bottle to be discharged through the nozzle by the application of a transverse force to the nozzle to tilt it which results in the closure member being unseated from the neck of the bottle and in the at least part of the end wall being deformed. In one example the closure member is integral with the cap (12) and in another example the closure member is separate from the cap (2).

10 Claims, 4 Drawing Figures

TILTING NOZZLE CLOSURE WITH DUAL SEALING SURFACES

BACKGROUND OF THE INVENTION

This invention relates to a closure for a bottle particularly a bottle with liquid contents which may be under a positive pressure. The closure includes a tilting nozzle through which the contents of the bottle are discharged.

Previously such closures have included a cap made from a plastics material with its side wall carrying an internal annular bead adjacent its open end for engagement with the neck of the bottle and its end wall including a tubular nozzle, the closure has also included a closure member arranged to seal against the open end of the bottle neck, the arrangement being such that the closure member can be partially lifted off the open end of the neck by a force applied laterally to the nozzle to tilt it, to discharge the contents of the bottle.

A known tilting nozzle closure of this kind is described in West German Offenlegungsschrift No. 2530232 and in the closure described in this specification the closure member is formed by the closed bottom end of the tilting nozzle. The nozzle is sealed through a central opening in the end wall of the cap and the closed bottom end of the nozzle includes an outer flange which engages the underside of the thickened rim portion of the end wall of the cap adjacent its side wall. When the closure is fitted on to the neck of a bottle the end wall of the cap engages the flange around the closed bottom of the nozzle and urges it against the open end of the bottle either directly or via an annular seal insert formed by soft, resilient material. The nozzle communicates with an annular chamber formed between the side wall of the cap and the upper end of the neck of the bottle by means of at least one radial duct through the side wall of the nozzle.

This closure suffers from various disadvantages. It is difficult to obtain a reliable seal between the closure member and the neck of the bottle when the closure does not include a separate sealing insert and this does not permit the closure to seal the bottle reliably when the contents of the bottle are under a positive pressure. Further, when the closure member includes a sealing insert a greater degree of tilting movement of the closure member is required before the contents of the bottle can be discharged.

Furthermore, the axial stress applied to the closure member to urge it against the open end of the bottle neck has to be provided by the side wall of the cap and, when the closure member is tilted to discharge the contents this axial stress in the side wall of the cap is increased. Firstly, this makes it more difficult to ensure a tight and positive sealing engagement between the annular bead on the internal face of the side wall of the cap and the outer annular bead on the bottle neck and, secondly, increases the risk that the cap will become disengaged from the bottle neck when the axial stress in the side wall is increased by tilting the nozzle. There is also a risk that, as a result of the transverse force applied to the nozzle to tilt it, the closure member will be displaced radially with respect to the open end of the bottle and, thereafter, not form an effective seal. Finally, it is possible that the duct through the side wall of the nozzle, particularly when this is opposite the point at which the transverse force is applied, will be constricted or closed when the nozzle is tilted.

Another closure is shown in the specification of West German Gebrauchsmuster No. 7036290 which is specifically arranged to be used with a bottle having contents under positive pressure. In the closure described in this specification the cap includes a resilient annular connection between the nozzle and the rim of the end wall together with a separate closure member and a sealing washer which is clamped between the open end of the neck of the bottle and the end wall of the cap. The separate closure member is located in the inside of the bottle neck and includes a spigot extending through the washer and into the inside of the nozzle. The closure member is urged towards the end wall of the bottle where it engages against the lower face of the sealing washer to form a seal by the pressure of the contents in the bottle.

The construction of this three part closure is complex and it is, therefore, difficult to produce and install. Moreover, the seal of the closure is only ensured whilst the internal positive pressure of the contents of the bottle is sufficient to thrust the closure member against the sealing washer.

SUMMARY OF THE INVENTION

The object of this invention is the provision of a tilt nozzle closure which can be simply produced, which seals reliably and tightly in use and which can be easily operated without a substantial part of the tilting force being transmitted to the connection between the closure and the bottle.

According to this invention a tilting nozzle closure for a bottle comprises a cap of plastics material having a side wall including an internal annular bead adjacent its open end for engagement with an outer bead on the neck of the bottle and an end wall carrying a nozzle, at least part of the end wall of the cap being more resilient than the side wall, and a closure member for sealing the bottle which, in use, engages the end of the neck and which includes a reduced portion, which in use projects into the neck, the arrangement being such that, in use, the at least part of the end wall is stressed by the attachment of the side wall to the neck of the bottle to urge the closure member against the neck to seal the bottle, the closure member being movable from sealing engagement with the bottle neck by application of a transverse force to the nozzle to tilt the nozzle and thereby unseat the closure member from the neck to discharge contents of the bottle, the at least part of the end wall being deformed to accommodate tilting of the nozzle.

The at least part of the end wall of the cap facilitates the tilting of the nozzle because of its resilient deformability and prevents substantial forces applied to tilt the nozzle being transmitted to the side wall of the cap.

Lateral displacement of the closure member upon tilting of the nozzle is prevented by the reduced portion of the closure member which projects into the neck of the bottle.

The closure member may be formed separate from the cap, and in this case it includes a spigot extending axially into the nozzle and means are provided to allow flow to take place between the inside face of the end wall of the cap and the closure member. However, the closure member may be formed integrally with the remainder of the cap and, in this case, the nozzle is preferably arranged eccentrically outside the reduced portion of the closure member.

When the closure member is formed separate from the remainder of the cap, the nozzle is preferably arranged centrally in the end wall of the cap and the end wall of the cap preferably includes protuberances defining radial openings between the closure member and the inside face of the end wall. Further it is preferred that longitudinal ribs are provided on the spigot portion of the closure member or on the internal wall of the nozzle to permit flow to take place between the spigot and the walls of the nozzle.

In both cases, the reduced portion of the closure member preferably seals against the internal wall of the neck of the bottle. The reduced portion may be tapered or may include an annular rib or lip surrounding its free edge to form a seal between the reduced portion and the internal wall of the neck of the bottle. In this way a more reliable seal is provided between the closure member and the neck of the bottle, since there is only a narrow annular contact surface between the closure member and the neck of the bottle and this provides a more reliable seal even when the closure member is made of conventional cap material and only a low contact pressure exists between the closure member and the neck of the bottle.

BRIEF DESCRIPTION OF THE DRAWING

Two examples of a closure in accordance with this invention will now be described with reference to the accompanying drawings; in which.

DETAILED DESCRIPTION OF THE DRAWING

Figure 1:
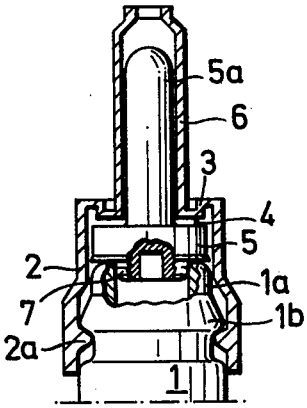
FIG. 1 is a partly sectioned side elevation of a first example in a closed position.

The two examples correspond with one another in that, in both examples a neck 1 of the bottle to be closed is surrounded by an annular bead 1*b* beneath its open end 1*a* and the side walls of closure caps 2 and 12 each include an inner annular bead 2*a* and 12*a*, respectively,- which are a snap fit-behind the annular bead 1*b* and form a tight sealing engagement between the caps 2 and 12 and the bottle 1 and prevent the caps 2 and 12 from lifting axially.

The two examples are also similar in that as the caps 2 and 12 are pushed onto the neck of the bottle 1 an axial stress is exerted in the side walls 2 and 12 since parts of closure members 5 and 15 engage the end of the neck of the bottle 1*a* before the internal annular bead 2*a* and 12*a* is completely pushed over the annular bead 1*b*. Thus, further axial movement of the cap to snap the annular bead 2*a* and 12*a* into position below the annular bead 1*b* deforms the end wall of the cap 2 and 12 and results in an axial stress being contained in the side wall of the cap 2 and 12.

An important difference between the two examples shown and the previously known caps is that the end wall of the cap is deformable in itself and with respect to the side wall of the cap and thus provides a substantial part of the closing force urging the closure member 5 and 15 towards the neck of the bottle.

Figure 2:
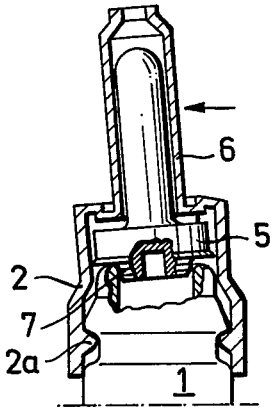
FIG. 2 is a partly sectioned side elevation of the first example in an open position.

In the example illustrated in FIGS. 1 and 2 the end wall of the cap 3 includes a tiltable nozzle 6 and the annular region of the end wall joining the side wall of the cap to the nozzle has a wall thickness which is less than that of the side wall. Further, in the relaxed state, before the cap is connected to the bottle, this annular region of the end wall forms an acute angle with the inside surface of the side wall and includes an annular step. Accordingly, the annular part of the end wall which surrounds the nozzle 6 forms a radial and axially resilient yielding diaphragm which allows mobility of the nozzle 6 with respect to the side wall of the cap 2 in both the radial and axial directions. In the illustrated example this annular portion is raised into a position into which it is perpendicular with respect to the side wall of the cap once the cap has been fitted to the neck of the bottle.

The closure member 5 includes a disc-shaped portion which bears against the end of the neck 1*a* of the bottle and forms a seal around the neck. The lid or closure member 5 bears against the inside face of the end wall of the cap by three radial strip like protuberances 4 which leave radial openings between an annular chamber between the nozzle 6 and an annular chamber surrounding the disc-like portion of the closure member. The closure member 5 also includes a spigot 5*a* which projects into the nozzle with a clearance between the spigot 5*a* and the internal wall of the nozzle.

The closure member 5 also includes a reduced portion 7 which extends into the opening of the bottle neck 1. As can be clearly seen by reference to FIG. 2, the extension converges conically with respect to the interior of the bottle and bears with its conical surfaces sealing against the internal wall of the open end of the neck of the bottle immediately before the surface merges with the lid member 5. This reduced portion 7 therefore improves the sealing action of the lid member 5. The reduced portion 7 may also include an annular rib to further improve its sealing action. The reduced portion 7 provides a reliable seal even if a relatively low closing force is stored in the annular portion of the end wall and the side walls of the cap.

Figure 3:
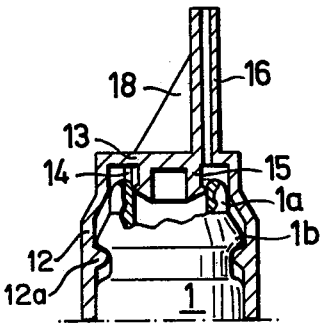
FIG. 3 is a partly sectioned side elevation of a second example in a closed position; and, FIG. 4 is a partly sectioned side elevation of the second example in an open position.
Figure 4:
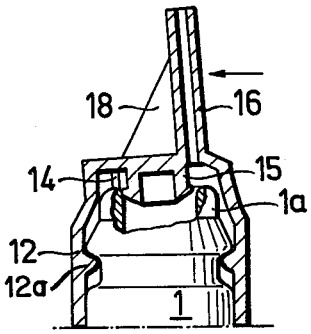

In the second example shown in FIGS. 3 and 4 the closure member 15 is formed by a part of the cap 12. In this case the closure member comprises an inner annular projection from the end wall of the cap 13 which projects into the open end of the bottle and, in the closed position forms a seal against the internal wall of the neck of the bottle by means of a circumferential annular rib or lip adjacent its free end. The inner annular projection or extension 15, which forms the reduced portion or the closure member 15 fulfills two functions: that of sealing the contents within the bottle; and that of centering the closure member with respect to the bottle neck. The penetration depth of the reduced portion 15 is determined by a ring 14 which engages the end of the bottle 1. The ring 14 is interrupted, at least in the region of the discharge opening of a nozzle 16 which in this example is placed eccentrically to and spaced from the rim of the cap. The interruption in the ring 14 enables the contents of the bottle to be discharged through the nozzle 16 once the seal between the reduced portion 15 and the neck of the bottle is released. The nozzle 16 is stiffened with respect to the central portion of the end wall of the cap 12 which forms a part of the closure member by a strut or web 18 to ensure that, as the nozzle 16 is tilted, the closure member including the reduced portion 15 is also tilted to release the seal between the reduced portion 15 and the neck of the bottle 1*a*.

The arrangement of the closure member on the inside of the cap bottom and the eccentric arrangement of the nozzle results in a reduced resilience of the end wall of the cap 13. The disadvantage of this factor compared with the first example is, however, compensated for in that the axial force required for sealing the opening of the neck of the bottle by means of the reduced portion 15 of the closure member is less than that required for sealing via the underside of the disc-shaped member 5 which bears against the open end of the bottle 1.

What is claimed is:

1. A tilting nozzle closure for attachment to the neck of a bottle which forms an outlet from the bottle, comprising a cap formed of a plastics material, said cap having an axially extending annular side wall arranged to extend downwardly around the neck of the bottle and an end wall extending transversely of the axial direction of and across said side wall, a tubular nozzle secured to and extending from said end wall in the opposite direction from said side wall, said side wall having an annular bead on the inner surface thereof and said annular bead arranged to fit downwardly over and in bearing contact with a similar bead on the neck of the bottle, at least a part of said end wall being more resilient than said side wall, and a closure member located within said cap having a first surface arranged to contact the end surface of the neck of the bottle and a second surface projecting in the axial direction of said side wall from said first surface and arranged to fit into and seal the inner surface in the neck of the bottle, said first and second surfaces arranged to form sealing surfaces with the neck of the bottle, said annular bead on said side wall being spaced from said end wall of said cap so that upon attachment of said cap onto the bottle the interengagement of said annular bead with the similar bead on the bottle stresses said side wall in the axial direction and pulls said end wall toward the neck of the bottle to bias said first and second surfaces on said closure member into sealing contact with the neck of the bottle, said closure member being at least partially displaceable from sealing contact with the neck of the bottle by applying force to said nozzle for tilting said nozzle transversely of the flow path therethrough, and said end wall of said cap being deformed for accommodating the tilting displacement of said nozzle and for transmitting the nozzle tilting action to said closure member.

2. The closure of claim 1, wherein said end wall of said cap is bowed inwardly into said side wall when said cap is relaxed and not engaged with the bottle.

3. The closure of claim 1, wherein said nozzle is located centrally of said end wall, said closure member is formed separate from said cap, and said closure member includes a spigot extending axially into and in spaced relation with the inner surface of said tubular nozzle, and wherein projection means provided on one of said end wall and said closure member between said end wall and said closure means to allow a flow to take place between the inside face of the said end wall and said closure member.

4. The closure of claim 1, wherein said closure member has a first portion with said first surface thereon and a reduced diameter second portion extending outwardly from said first surface with said second surface thereon, and said reduced diameter second portion of said closure member is tapered.

5. The closure of claim 1, wherein said closure member is formed integrally with said cap and said nozzle is arranged eccentrically to and spaced inwardly from the rim of the cap, said closure member has a first portion with said first surface thereon and a reduced diameter second portion extending outwardly from said first surface with said second surface thereon, and said reduced portion of said closure member having a free edge spaced from said first surface, and, including an annular rib or lip surrounding the free edge, said annular rib or lip arranged forming a seal against the inner surface of neck of said bottle.

6. The closure of claim 5 wherein said closure member includes a ring surrounding the end of said reduced portion adjacent to said end wall, said ring arranged to engage the end surface of the neck, and said ring being interrupted adjacent the upstream end of said nozzle for admitting the flow of material from the bottle to said nozzle.

7. The closure of claim 6, wherein a buttressing strut or web is attached to said nozzle and said end wall of said closure member to ensure that said closure member tilts together with said nozzle.

8. A tilting nozzle closure, as set forth in claim 1, wherein with the tilting nozzle closure located in the upright position on the neck of a bottle, said first surface of said closure member is disposed substantially horizontally and said second surface is disposed substantially vertically.

9. A tilting nozzle closure and bottle combination comprising a bottle having a neck including an external annular bead projecting outwardly from the outer surface of said neck, and a closure comprising a cap made of plastics material, said cap having an annular side wall and an end wall extending transversely of and across said side wall, said side wall including an annular bead formed on and extending inwardly from the inner surface of said side wall for engagement with said external annular bead on said neck of said bottle, said end wall including a tubular nozzle extending outwardly therefrom in the opposite direction from said side wall, at least part of said end wall of said cap being more resilient than said side wall, and a closure member located within said cap and in engagement with said end wall for sealing said bottle, said closure member engaging the end of said neck of said bottle and including a reduced portion projecting into said neck in sealing engagement with an inner part of said neck upon attachment of said cap to said bottle, said at least part of said end wall being stressed for biasing said closure member against said neck to seal said bottle in two places when said annular bead on said cap fits downwardly over and bears against said external annular bead, said closure member being movable from sealing engagement with said neck by application of a transverse force to said nozzle for tilting said nozzle and through the engagement of said end wall and closure member thereby unseating said closure member at least partially from said neck, said at least part of said end wall being deformed to accommodate the tilting of said nozzle.

10. The closure and bottle combination of claim 9, wherein said end wall of said cap is bowed inwardly into said side wall when said cap is separated from said bottle and wherein upon attachment of said cap to said bottle with said annular bead on said cap fitted downwardly over said annular bead on said neck said end wall is stressed into an unbowed configuration.

* * * * *